US007152755B2

(12) United States Patent
Azzarello

(10) Patent No.: US 7,152,755 B2
(45) Date of Patent: Dec. 26, 2006

(54) PLASTIC CONTAINER WITH INTEGRAL BAIL

(75) Inventor: Frances T. Azzarello, Woodstock, IL (US)

(73) Assignee: United States Can Company, Lombard, IL (US)

( * ) Notice: Subject to any disclaimer, the term of this patent is extended or adjusted under 35 U.S.C. 154(b) by 239 days.

(21) Appl. No.: 10/611,332

(22) Filed: Jul. 1, 2003

(65) Prior Publication Data

US 2005/0000972 A1 Jan. 6, 2005

(51) Int. Cl.
*B65D 25/32* (2006.01)

(52) U.S. Cl. ..... 220/773; 220/760; 220/771; 220/776

(58) Field of Classification Search ..... 220/760, 220/771, 773, 776
See application file for complete search history.

(56) References Cited

U.S. PATENT DOCUMENTS 2,710,705 A * 6/1955 Balint et al. ..... 220/769
3,207,298 A * 9/1965 Wilson ..... 206/364
3,208,630 A * 9/1965 Bauer ..... 220/758
3,331,527 A * 7/1967 Kaas et al. ..... 220/270
4,357,042 A * 11/1982 Gall ..... 294/31.2
4,380,304 A * 4/1983 Anderson ..... 220/782
5,027,973 A * 7/1991 Drogos ..... 220/657
5,526,954 A * 6/1996 Georgiadis ..... 220/760
5,875,913 A * 3/1999 Letica ..... 220/269
6,443,325 B1 * 9/2002 Schaper et al. ..... 220/771

* cited by examiner

*Primary Examiner*—Stephen Castellano
*Assistant Examiner*—Eugene Lhymn
(74) *Attorney, Agent, or Firm*—Polster, Lieder, Woodruff & Lucchesi L.C.

(57) ABSTRACT

A one-piece, molded plastic container (10) comprises a base (16) and a circumferential sidewall (20) extending upwardly from the base. The upper end (18) of the sidewall forms an open top of the container which is closed by a lid (19). A bail (14) for lifting and carrying the container is integrally molded with the container body in a mold (100). The ends of the bail attach to bosses (22*a*, 22*b*) integrally molded therewith into the container sidewall. The spacing of the bosses is less than 180° in one direction about the circumference of the container, so the container, when lifted by the bail, does not hang vertically. A base section (14*b*) of the bail has a substantially uniform thickness throughout the length of the bail.

20 Claims, 2 Drawing Sheets

PLASTIC CONTAINER WITH INTEGRAL BAIL

CROSS REFERENCE TO RELATED APPLICATIONS

Ser. No. 09/712,613

STATEMENT REGARDING FEDERALLY SPONSORED RESEARCH OR DEVELOPMENT

N/A

BACKGROUND OF THE INVENTION

This invention relates to plastic containers such as paint cans and the like, and more particularly, to such a container having a bail for holding the can integrally formed therewith.

Plastic containers are known in the art. U.S. Pat. Nos. 3,000,527, 3,623,633, 3,889,732, 4,796,775, 5,027,973, 5,125,530, 5,215,210, 5,520,306, and 5,526,954 being representative examples. Typically, plastic containers are currently formed of many separate pieces. A first piece comprises an injection molded container body. A second piece includes ears formed on the side of the container using slides in the mold by which the container is formed. A third piece is a cover, also made of plastic, which fits over the open, upper end of the container. A fourth piece is a bail made of either plastic or a wire. The ends of the bail attach to the ears formed on the side of the container and the bail is used to both lift the container and to suspend it from a hook or the like. The ears to which the ends of the bail attach are opposed ears formed 180° apart. With such an arrangement, the container hangs vertically regardless of the amount of material in the container. If the container is filled with paint, for example, as more paint is used, the vertical hang of the pail makes it increasingly difficult to dip a paint brush far enough into the container to wet the brush with paint.

Some containers, for example, the container shown in U.S. Pat. No. 3,000,527 referred to above, and a recently introduced container sold by Sherwin Williams do not have the ears located 180° apart, but rather at some other angle. However, both of these plastic container constructions have certain disadvantages. For example, in the construction shown in the '527 patent, integral molding is not possible. Rather, insertion of a bail requires heat to be applied to the container to make it sufficiently pliable so the bail can be stretched over a flange portion of the container. This is costly with respect to both the amount of energy and labor required to manufacture the container.

In addition to the foregoing, it is a common feature of conventional plastic containers that they incorporate a living hinge with the bail or handle construction. The living hinge comprises a region of reduced thickness allowing the bail to be bent or folded into an upright posture for gripping by the user. Over time, the bail will fail at this point due to the flexing of the plastic material as the handle is moved from its level to upright position and back. Because of this, such containers are considered by consumers to be weak.

Besides the foregoing, lower cost plastic containers having a non-rigid geometry at their open end, and which employ a plastic bail, have an additional problem. This is that because of the lack of hoop strength at the open end of the container the top of the container will tend to deform or "ovalize" due to the weight of the contents of the container. This often results in spillage of the container's contents.

Another problem with such containers is that if the container has an integrally molded bail, the bail will tend to interfere with brush insertion if the container is placed on a horizontal surface after it has been hanging for a while. This is because of residual strain which causes the bail to remain in a somewhat arched position over the mouth of the container making it difficult to dip the brush into the container.

BRIEF SUMMARY OF THE INVENTION

Among the several objects of the invention will be noted a one-piece, molded plastic container having a base and a circumferential sidewall extending upwardly from the base. The container can vary in size to up to five gallons or more. The upper end of the sidewall forms an open top of the container. A bail for lifting and carrying the container is also of an integrally molded plastic. Respective ends of the bail attach to the sidewall of the container adjacent the upper, open end thereof. The sidewall has bosses integrally molded therewith, the bosses projecting outwardly from the sidewall for connecting the ends of the bail to the container. The spacing between the bosses is between 130°–150° about the circumference of the container. When the container is full and is lifted by the bail, the container hangs vertically. However, as the contents of the container are used up or poured out, the container does not hang vertically, but rather at an angle. This allows ease of access to the contents of the container as the container is emptied.

The bail used with the container, although a separate piece, is integrally molded with the polymeric body of the container as part of the body mold. This significantly reduces costs for both the manufacture and assembly of the completed container. Further, the bail has a base section of constant thickness throughout the length of the bail. There are no regions of reduced thickness comprising a living hinge type construction. Also, the open end of the container has a wide cross-section geometry which keeps the open end from deforming and causing spillage of the container's contents.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

FIG. 3*a* is a side sectional view of the container taken along line 3*a*—3*a* in FIG. 1;

FIG. 3*b* is an enlarged sectional view of a portion of the container shown in FIG. 3*a;*

Corresponding reference characters indicate corresponding parts throughout the several views of the drawings.

DETAILED DESCRIPTION OF INVENTION

Figure 1:
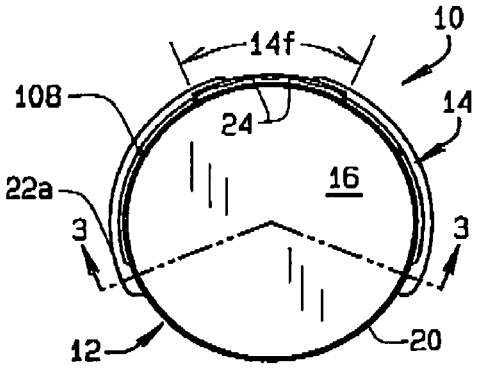
FIG. 1 is a top plan view of a container of the present invention.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Referring to the drawings, a plastic container of the present invention is indicated generally 10 in the drawings. Container 10 is, for example, a gallon size container used for holding and storing paint. It will be understood by those skilled in the art that the container may be of other convenient sizes (pint, quart, one gallon, two gallon, up to five gallons or more) and can be used for holding and storing a variety of fluent materials besides paint. Unlike conventional plastic containers which comprise three or more pieces containers including a container body, ears attached to the side of the body, and a bail the ends of which are attached to the ears, container 10 is formed of only two pieces, a body 12 and a bail 14 which attaches to the container body. This two-piece construction reduces both time and cost in the manufacture and assembly of the container.

Figure 4:
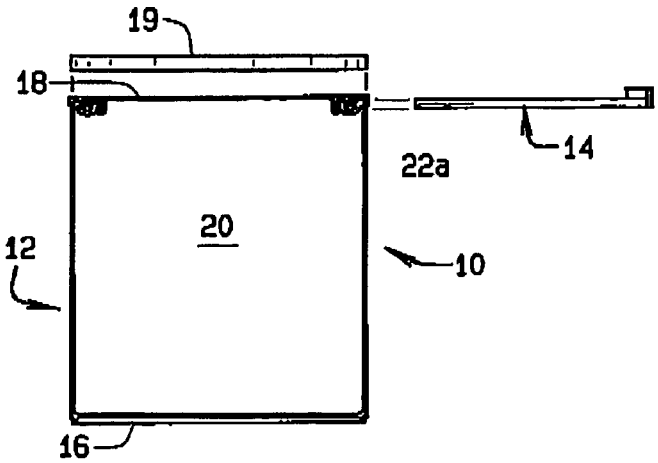
FIG. 4 is another side elevation of the container showing a boss formed on the side of the container to which one end the bail attaches.

Container body 12 is an injection molded unit having a rounded contour, an integrally formed closed bottom end or base 16, and an open, upper end 18. A ring 15 having a flange 15F is fitted over the open, top of the container (See FIG. 3*b*). The ring is attached to the upper end of container 10 by spin welding. A plug or lid 19 (see FIG. 4) fits over the open end 18 of the can to seal the contents of the container when in place. The cover is readily removable to access the contents of the can and reseals the container when put back in place. While container 10 is shown in the drawings to have a constant diameter along its length, those skilled in the art will appreciate that the container body can have a tapered diameter with the diameter at the upper end of the container being greater than that at the bottom of the container. In accordance with the invention, bail 14, which is also a molded plastic piece more fully described hereinafter, attaches to a circumferential sidewall 20 of the container body, near the upper, open end of the container. The bail attaches to the container using bosses 22*a*, 22*b* integrally molded with the container body and projecting outwardly from opposite sides of the container. Importantly, the bosses are preferably located approximately 140° apart, as best shown in FIG. 1, rather than being opposite each other as found in conventional container constructions. The bosses can be located between 130°–150° apart without departing from the scope of the invention.

Bail 14 has a cross-sectional area of approximately 0.025 $in^2$ (0.16 $cm^2$). As such, the bail has a safety factor of approximately 7:1 with respect to break strength. This safety factor assumes a content (paint) weight of twelve pounds at a temperature of 100° F. (37.8° C.) for a one gallon container. The relatively stiff cross-section makes bending the bail difficult. This stiffness is desirable because it permits a large bend radius. It, also, significantly reduces the tensile strength on the outer surface of the bail, and means the bail can be worked (bent or folded back-and-forth) many times without breaking due to fatigue.

Figure 2:
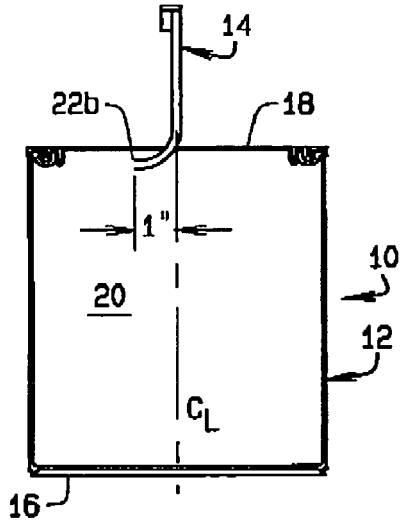
FIG. 2 is a side elevation of the container.

The large bend radius also affects the container's center of gravity. In a container with the bosses 180° apart, when the container is full, its center of gravity is not on a vertical line which would pass through a gripping point on the bail. This is the condition when the container is carried or suspended as, for example, from a hook. Rather, container 10 will tend to repose at an angle of less than 90° to the ground. Normally, this would cause the contents of the container to spill. To prevent this, the bail's attachment bosses 22*a*, 22*b*, are offset from the centerline $C_L$ of the container by approximately 1"(2.54 cm). This is as shown in FIG. 2. The cumulative offset of the two bosses creates the 140° spacing noted above which, in turn, counters the tendency of container 10 to be displaced at an angle with respect to the vertical.

Figure 5:
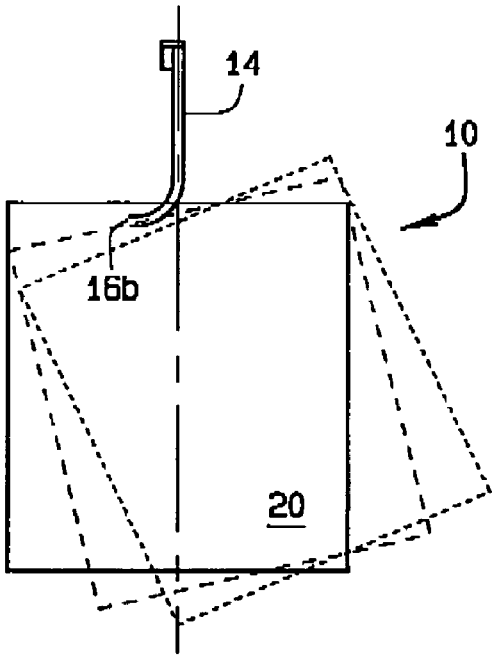
FIG. 5 illustrates the angle of the container to vertical as the contents of the container are consumed.

In addition to the construction features of container 10 and bail 14, the mechanical properties of the material from which the container and bail are made, the geometry of the bail's cross-section, and the offset of the attachment bosses, all combine to enable the container to sit and hang properly. Those skilled in the art will note that, as the contents of container 10 are consumed, so there is less paint (or other liquid) in the container, the angle at which the container resides moves further away from the vertical. This is as shown in FIG. 5. Here, the solid line representation of the container illustrates its position when the container is full. As the contents of the container are consumed, the tilt of the container to vertical gradually increases from the solid line to the dashed line representation, and then to the dotted line representation of the container. As the angle of tilt increases with the falling content level, spillage becomes less of a problem because the level of the container's contents is lower. There is also now an increase in the space between the bail and the top of the container. This makes it easier to access the contents. In a paint can, for example, it becomes increasingly easier to insert a paint brush into the can and extend it deeper into the can to load the brush with paint.

Figure 6:
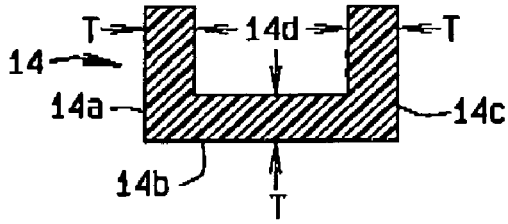
FIG. 6 is a cross-section of the bail of the container taken along line 6—6 in FIG. 3.

Referring to FIG. 6, bail 14 is shown to be of a generally U-shaped. The molded channel construction has a sidewall 14*a*, a base section 14*b* along one side of which sidewall 14*a* is formed, and a sidewall 14*c* formed along the opposite side of the base. These three sections are of a constant thickness T, which generally corresponds to the thickness of sidewall 20 of container 10. Such construction has the advantage, during the molding of the container, of providing constant mold cooling and a uniform heat distribution. This prevents warping of the parts. The length of each wall of the bail is approximately the same, and a channel 14*d* formed by the walls 14*a*–14*c* has sidewalls of generally the same length. Importantly, base 14*b* of the bail is of a uniform thickness T throughout the length of the bail. That is, there are no regions of reduced thickness such as would be found were the bail to incorporate a living hinge at each end of the bail. Those skilled in the art will understand that other bail geometries could also be employed without departing from the scope of the invention.

Figure 7:
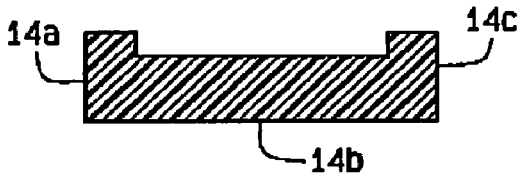
FIG. 7 is a similar cross-section taken along line 7—7 in the Fig.; and, FIG. 8 is a cross-section of a mold used to manufacture the container and bail as a single unit.
Figure 8:
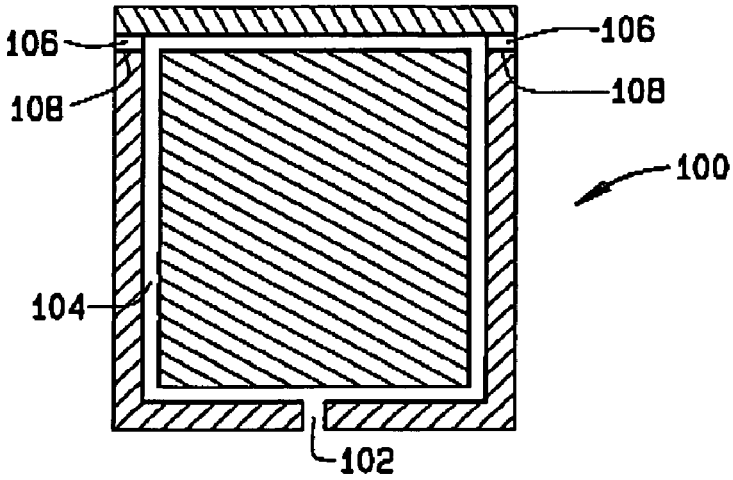

As shown in FIG. 7, the shape of bail 14 transitions to a more flattened aspect in which walls 14*a* and 14*c* become more shorter in length than wall 14*b*. This flattened bail segment, indicated 14*f* in FIG. 1, begins substantially equidistantly from the bosses 22*a*, 22*b* on the side of the container where bail 14 attaches. The length of bail segment 14*f* is, for example, approximately 4"(10.2 cm). When bail 14 is raised to its substantially vertical can carrying position (see FIGS. 2 and 3*a*), it extends parallel to the hand of the person carrying the can. This portion of the bail gripped by the person is segment 14*f*. The flattened aspect of the bail serves to distribute the weight of container 10 across the fingers of the person's hand as they grip the bail. This helps reduce stress on the fingers while making it easier to lift and carry the container. Bail segment 14*f* incorporates grooves 24 shaped to the contour of the fingers so as to further reduce the stress on the fingers.

For injection molding of container 10 and bail 14, a mold 100 is filled from a gate 102 in the center of the bottom of the mold. A plasticized resin material flows radially outwardly from the gate across the bottom of the mold and then up a sidewall 104 of the mold body. Near the top of mold 100, additional resin material flows into mold bosses 106 which are spaced approximately 140° apart, and then into bail 14 so that bail 14 and container 20 form a one piece unit when removed from the mold. There are also additional small gates, which form tabs 108, spaced radially about the top of the container, away from the bosses, and which help the flow of plasticized material into the bail area to reduce gassing and weld lines which tend to weaken the bail. The bail remains attached to the can body until someone breaks off the attachment tabs 108. However, bail 14 typically remains attached to the can body as the unit goes through filling and packing equipment. If the tabs are broken prematurely, bail 14 could be "out of place" and catch on a machine part causing a jam.

The bail construction of the present invention has a further advantage to those previously described. Prior art polymeric containers having integrally molded bails have a problem with respect to interference to insertion of a paint brush or the like into the container, when the container, having been suspended from a support, is now placed on a horizontal surface. This is because there is a residual strain in the bail due to the container having been suspended with the bail supporting the suspension. This strain causes the bail to remain arched over the top of the container making it difficult to dip the brush into the container.

The molded container construction of the present invention eliminates this problem because bail 14 is latched in a horizontal position. This is achieved because integrally fanned bail 14 is molded to the upper, open end of container 10. As shown in the sectional view of the container in FIG. 3*b*, ring 15 is attached to the top of the container. The ring has a flange 15*f* whose outer diameter is greater than the outer diameter of the container body. As noted, the tabs 108 must be broken to allow bail 14 to swing upwardly. This break will occur at the interface with the sidewall of container 10 so the tabs, in effect, become part of the bail. To position bail 14 in the carry position, the bail must be pulled up and slightly stretched so the tabs snap past flange 15*f* of ring 15. If instead of being carried or suspended, container 10 is set upon a surface, bail 14 is readily snapped back over the ring flange. The tabs are formed where bail 14 transitions from its channel section shown in FIG. 6 to its flattened section shown in FIG. 7. This is so the tabs will not be on the flat, hand grip portion of the bail.

Alternatively, a plastic bail 14 can be attached to a metal can (not shown) using a non-pivotal set of connections such as can be made using a high strength adhesive to attach the ends of the bail to the sidewall of the metal can body. Off-center attachment points similar to the bosses 22*a*, 22*b* of container 10 are utilized in this embodiment.

In view of the above, it will be seen that the several objects and advantages of the present invention have been achieved and other advantageous results have been obtained.

Having thus described the invention, what is claimed and desired to be secured by Letters Patent is:

1. In a one-piece, molded plastic container, the improvement comprising:

a container body having a base and a circumferential sidewall extending upwardly from the base, the upper end of the sidewall forming an open top for the container; and, a bail for lifting and carrying the container, the bail being a plastic bail integrally molded with the container body and the bail having a bail base and a bail sidewall, the respective ends of the bail being formed with the sidewall of the container body adjacent an upper, open end thereof, the sidewall having bosses integrally molded therewith and projecting outwardly from the sidewall for connecting the ends of the bail with the container body, the spacing of the bosses being less than 170° apart whereby the container, when empty and lifted using the bail does not hang vertically, but when full does hang vertically and whereby the thickness of the bail base is uniform throughout the length of the bail, and the base and sidewalls of the bail are of substantially the same thickness as the sidewall of the container body such that the bail has a bend radius that is free from having a living hinge at the connection of the bail and the bosses.

2. The improvement of claim 1 in which the bosses are spaced approximately 140° apart.

3. The improvement of claim 1 in which the cross-section of the bail is transformed from a channel shape to a substantially flattened shape at a point intermediate the ends of the bail and substantially equidistant from the bosses on the side of the container body where the bail attaches to the container.

4. The improvement of claim 1 further including a ring attached to the upper end of the container, the ring having a flange extending outwardly from the container and tabs being integrally formed on the bail and on the container body, wherein the tabs separate from the container body and bias against the flange in order to extend past the flange when the bail is lifted to a vertical position and wherein the tabs bias against the flange in order to extend past the flange when the bail is returned to a horizontal position.

5. The improvement of claim 4 in which, when the bail is raised to the vertical position for carrying the container, the substantially flattened shape of the bail extends horizontally, parallel to the ground, to facilitate lifting and carrying of the container, the weight of the container now being distributed across the fingers of the person lifting and carrying the container thereby reducing the stress on the fingers.

6. The improvement of claim 5 further including grooves formed on the substantially flattened shape of the bail to further reduce stress on the fingers.

7. A container for paint and other fluent materials comprising:

a container body including a base and an integrally molded circumferential sidewall extending upwardly from the base, the upper end of the sidewall forming an open top for the container;

a bail for lifting and carrying the container, the bail being a plastic bail integrally molded together with the container and the bail having a bail base and a bail sidewall, the bail being initially attached to the container body by tabs formed in the mold with the bail and the container body, the bail being subsequently detached from the container body by breaking off the tabs from the container body, the sidewall having attachment bosses integrally molded therewith and projecting outwardly from the sidewall for connecting the ends of the bail to the container body, and wherein the thickness of the base is uniform throughout the length of the bail, and the bail base and sidewalls of the bail are of substantially the same thickness as the sidewall of the container body such that the bail has a bend radius that is free from having a living hinge at the connection of the bail and the bosses; and, a ring fitting onto the upper end of the container and having a flange extending outwardly from the container, wherein the tabs bias against the flange in order to extend past the flange when the bail is lifted to a vertical position and wherein the tabs bias against the flange in order to extend past the flange when the bail is returned to a horizontal position.

8. The container of claim 7 wherein the spacing of the bosses is less than 170° apart whereby the container, when empty and lifted using the bail does not hang vertically; but when full, does hang vertically.

9. The container of claim 8 in which the bosses are spaced approximately 140° apart.

10. The container of claim 9 wherein the bail comprises a generally U-shaped channel, in cross-section, having a base and respective sidewalls, the base and sidewalls being of a constant thickness.

11. The container of claim 10 in which the cross-section of the bail is modified from a channel shape to a substantially flattened shape at a point intermediate the ends of the bail and substantially equidistant from the bosses on the side of the container body where the bail attaches to the container body.

12. The container of claim 11 in which the substantially flattened shape of the bail extends vertically, parallel to the longitudinal centerline of the container body when the container is set in place.

13. The container of claim 12 in which, when the bail is raised to a vertical position for carrying the container, the flattened aspect of the bail extends horizontally, parallel to the ground, to facilitate lifting and carrying of the container, the weight of the container now being distributed across the fingers of the person lifting and carrying the container thereby reducing the stress on the fingers.

14. A paint can comprising:

a plastic molded can body including a base with an integrally formed circumferential sidewall extending upwardly from the base, the upper end of the sidewall forming an open top for the container;

a plastic lid for covering the opening to shut the can; and, a bail for lifting and carrying the container, the bail being a plastic bail integrally molded together with the can and attached to the can by tabs formed in the mold and the bail having a bail base and a bail sidewall, the bail subsequently being detached from the can by breaking off the tabs from the can body, and the sidewall of the can body having attachment bosses integrally molded therewith and projecting outwardly from the sidewall for connecting the ends of the bail to the can, and wherein the thickness of the bail base is uniform throughout the length of the bail, and the base and sidewalls of the bail are of substantially the same thickness as the sidewall of the container body such that the bail has a bend radius that is free from having a living hinge at the connection of the bail and the bosses.

15. The paint can of claim 14 wherein the spacing of the bosses being less than 180° apart for the paint can, when empty and lifted using the bail does not hang vertically, but when full does hang vertically.

16. The paint can of claim 15 in which the bosses are spaced approximately 140° apart.

17. The paint can of claim 14 wherein the ball comprises a generally U-shaped channel, in cross-section, having a base and respective sidewalls, the base and sidewalls being of a constant thickness.

18. The paint can of claim 17 in which the cross-section of the bail is modified from a channel shape to a substantially flattened shape at a point intermediate the ends of the bail and substantially equidistant from the bosses on the side of the container body where the bail attaches to the container body.

19. The paint can of claim 18 in which, when the bail is raised to a vertical position for carrying the container, the substantially flattened shape of the bail extends horizontally, parallel to the ground, to facilitate lifting and carrying of the container, the weight of the container now being distributed across the fingers of the person lifting and carrying the container thereby reducing the stress on the fingers.

20. The paint can of claim 14 further including a ring attached to the upper end of the container, the ring having a flange extending outwardly from the container and tabs being integrally formed on the bail, the tabs bias against the flange in order to extend past the flange when the bail is lifted to a vertical position and wherein the tabs bias against the flange in order to extend past the flange when the bail is returned to a horizontal position.

* * * * *

UNITED STATES PATENT AND TRADEMARK OFFICE

CERTIFICATE OF CORRECTION

PATENT NO. : 7,152,755 B2
APPLICATION NO. : 10/611332
DATED : December 26, 2006
INVENTOR(S) : Francis T. Azzarello It is certified that error appears in the above-identified patent and that said Letters Patent is hereby corrected as shown below:

On Title page of the patent next to (75) Inventor:
replace "Frances T. Azarello" with -- Francis T. Azzarello --

Signed and Sealed this

Twenty-sixth Day of June, 2007

JON W. DUDAS
*Director of the United States Patent and Trademark Office*